US007979008B2

(12) United States Patent
Kim et al.

(10) Patent No.: US 7,979,008 B2
(45) **Date of Patent: *Jul. 12, 2011**

(54) TONER SUPPLYING DEVICE, DEVELOPING DEVICE AND IMAGE FORMING APPARATUS HAVING TONER SUPPLYING DEVICE

(75) Inventors: Sung-dae Kim, Suwon-si (KR); Young-min Yoon, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1178 days.

This patent is subject to a terminal disclaimer.

(21) Appl. No.: 11/708,010

(22) Filed: Feb. 20, 2007

(65) Prior Publication Data

US 2008/0050131 A1 Feb. 28, 2008

(30) Foreign Application Priority Data

Aug. 25, 2006 (KR) ..... 10-2006-0081154

(51) Int. Cl.
*G03G 15/08* (2006.01)

(52) U.S. Cl. ..... 399/258; 399/263

(58) Field of Classification Search ..... 399/258, 399/263

See application file for complete search history.

(56) References Cited

U.S. PATENT DOCUMENTS

| | | | | |
|---|---|---|---|---|
| 5,099,278 | A * | 3/1992 | Sato | 399/75 |
| 5,325,151 | A | 6/1994 | Kimura et al. | |
| 6,671,475 | B2 * | 12/2003 | Katada et al. | 399/111 |
| 7,421,235 | B2 * | 9/2008 | Choi | 399/263 |
| 2001/0008590 | A1 | 7/2001 | Katada et al. | |
| 2007/0019994 | A1 * | 1/2007 | Choi | 399/254 |

FOREIGN PATENT DOCUMENTS

| | | |
|---|---|---|
| JP | 08334952 | 12/1996 |
| JP | 2000298387 | 10/2000 |

OTHER PUBLICATIONS

European Search Report issued Sep. 22, 2010 in EP Application No. 07108678.9.

* cited by examiner

*Primary Examiner* — David P Porta
*Assistant Examiner* — Bryan P Ready
(74) *Attorney, Agent, or Firm* — Stanzione & Kim, LLP

(57) ABSTRACT

A toner supplying device which is capable of individually supplying toners of different colors. The toner supplying device can include a driving source; a plurality of toner receptacles in which different color toners are contained and respective toner discharging members are provided in order to discharge toners while being driven by power transmitted from the driving source; and a plurality of spring clutches to selectively transmit power from the driving source to the toner discharging members. The toner supplying device according to the present general inventive concept can be advantageously employed in toner-refill type color image forming apparatuses in view of the miniaturization of the apparatus and reduction in the manufacturing costs.

20 Claims, 6 Drawing Sheets

TONER SUPPLYING DEVICE, DEVELOPING DEVICE AND IMAGE FORMING APPARATUS HAVING TONER SUPPLYING DEVICE

CROSS-REFERENCE TO RELATED APPLICATIONS

This application claims the benefit under 35 U.S.C. §119 (a) of Korean Patent Application No. 10-2006-0081154, filed on Aug. 25, 2006, in the Korean Intellectual Property Office, the entire disclosure of which is hereby incorporated by reference.

BACKGROUND OF THE INVENTION

1. Field of the Invention

The present general inventive concept relates to a color toner supplying device of a toner-refill type color image forming apparatus and a developing device having the same, and an image forming apparatus having the developing device.

2. Description of the Related Art

Toner-refill type color image forming apparatuses comprise four toner receptacles for storing respective color toners, such as yellow, magenta, cyan and black. The four toner receptacles include augers, which are toner discharging members for discharging toners from inside the toner receptacles to the outside.

The augers may be rotated by power transmitted from a driving source. Accordingly, the augers are connected to the driving source using electric clutches, so that only the auger of the toner receptacle containing an insufficient amount of a color toner is rotated to supply the corresponding color toner to the developing device. At the same time, the augers of the other three toner receptacles containing sufficient amounts of the three other color toners are not rotated because the electric clutches are turned off.

However, when using the above electric clutches as a power control unit in the toner supplying device, which is capable of supplying each color toner individually, the size of the developing device is large due to the required size of the electric clutches. Additionally, the manufacturing costs of the developing device and/or the image forming apparatus is large due to the expensive electric clutches.

SUMMARY OF THE INVENTION

The present general inventive concept provides a toner supplying device which is capable of reducing manufacturing costs and achieving miniaturization of a developing device and/or an image forming apparatus by employing an inexpensive and small spring clutch as a power control unit.

The present general inventive concept also provides a developing device and an image forming apparatus having the toner supplying device described above.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a toner supplying device including a driving source, a plurality of toner receptacles, in which different color toners are contained and respective toner discharging members are provided in order to discharge the toner while being driven by power transmitted from the driving source, and a plurality of spring clutches to selectively transmit power from the driving source to the toner discharging members.

In an exemplary implementation, the spring clutches may include a driving shaft connected to the driving source, a clutch hub connected to the driving shaft so as to rotate together with the driving shaft, a clutch collar mounted on the driving shaft so as to be selectively rotated, a first gear member mounted on the driving shaft so as to be selectively rotated, a spring of which one end is fixed to the clutch collar and the other end is fixed to the first gear member to connect the clutch hub to the first gear member, and a solenoid to stop rotation of the clutch collar to release the connection of the spring and the clutch hub.

In an exemplary implementation, a second gear member meshed with the first gear member may be provided. The first and second gear members have power transmission structures of worms and worm gears.

In an exemplary implementation, the driving shaft and the clutch hub can be engaged with splines or serrations.

Four toner receptacles and four spring clutches may be provided. The spring clutches control power transmitted to the toner discharging members of each toner receptacle.

A developing device may include a developing case comprising a plurality of toner containers containing toners of different colors, a developing roller mounted to each end of the toner containers of the developing case, and a toner supplying device as described above which is capable of individually supplying each toner to the corresponding toner containers.

The developing device may include a toner amount detecting sensor unit to detect the amount of toner contained in each toner container, and a controller to receive information from the toner amount detecting sensor unit to drive the solenoid corresponding to the toner container containing toner in insufficient amounts.

The foregoing and/or other aspects and utilities of the present general inventive concept may also be achieved by providing an image forming apparatus including a photosensitive medium on which an electrostatic latent image is formed, a developing device to develop the electrostatic latent image formed on the photosensitive medium in which toners of different colors are transferred and attached, an intermediate transfer belt on which developed toner images on the photosensitive medium are overlapped and transferred, and a transfer unit to transfer the toner images to a printing medium. The developing device may include a developing case including a plurality of toner containers to contain toners of different colors, a developing roller mounted to each end of the toner containers of the developing case, and a toner supplying device as described above which is capable of individually supplying each toner to the corresponding toner containers.

The foregoing and/or other aspects and utilities of the present general inventive concept may also be achieved by providing an image forming apparatus including a toner supplying device including a plurality of toner receptacles in which different color toners are contained and respective toner discharging members are provided in order to discharge toners from corresponding toner receptacles when driven by a driving source, and a plurality of driving shafts connected along a line by universal joints, each driving shaft corresponding to a respective one of the toner receptacles, each one of the plurality of driving shafts driven independently of the others to drive the respective discharging member.

The image forming apparatus may further include a plurality of spring clutches, each spring clutch connected with a respective one of the drive shafts to selectively transmit power from the driving source to a respective one of the toner discharging members via the respective connected drive shaft.

The spring clutches may include a respective drive shaft connect to the driving source, a clutch hub connected to the respective drive shaft to rotate together with the drive shaft, a clutch collar and first gear member mounted on the driving shaft to be selectively rotated, a spring selectively connecting the clutch hub to a first gear member to transmit power; and a solenoid to stop the rotation of the clutch collar to release the connection between the spring and the clutch hub.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

Throughout the drawings, the same drawing reference numerals will be understood to refer to the same elements, features and structures.

DETAILED DESCRIPTION OF THE PREFERRED EMBODIMENTS

Figure 1:
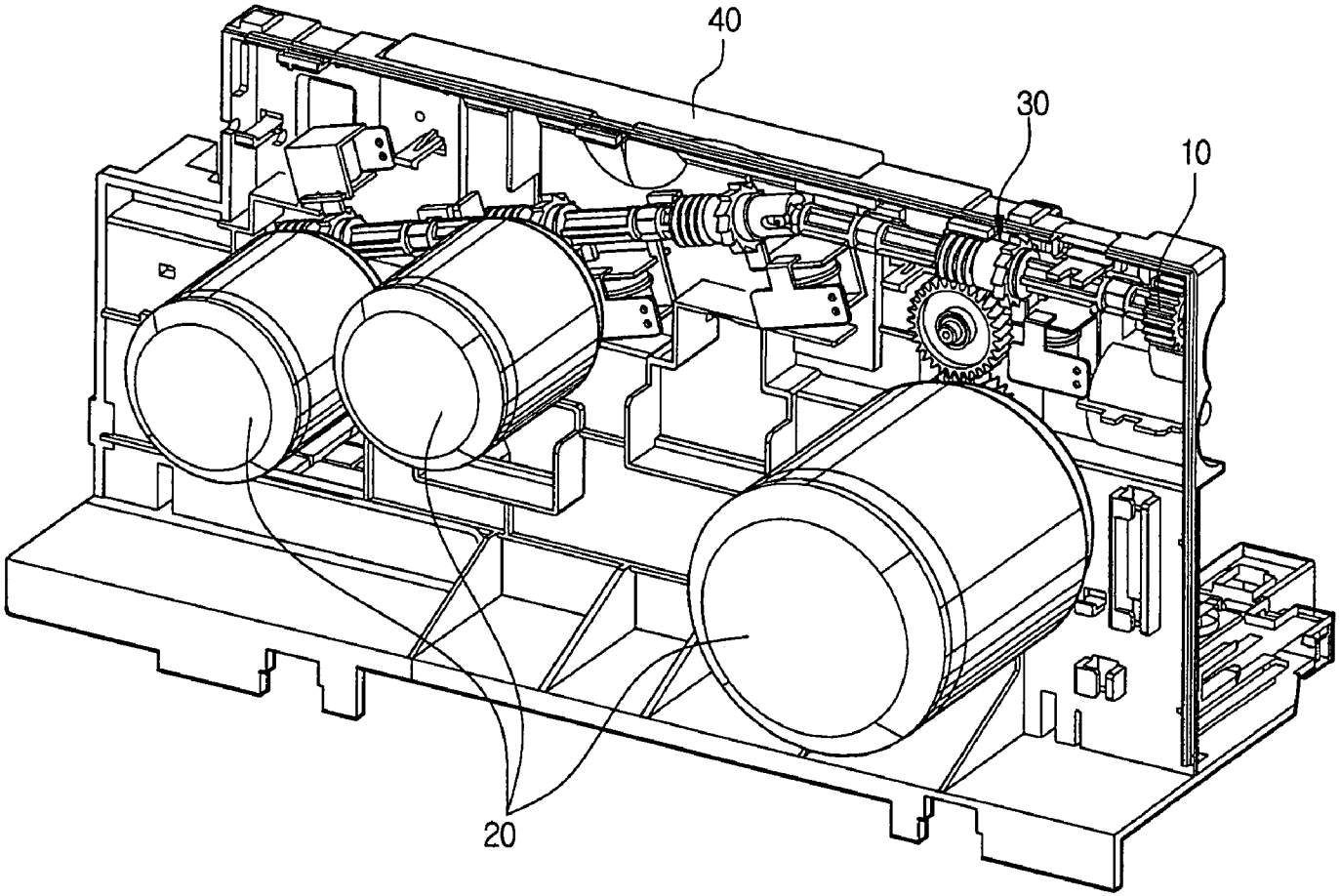
FIG. 1 is a schematic perspective view of a toner supplying device according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
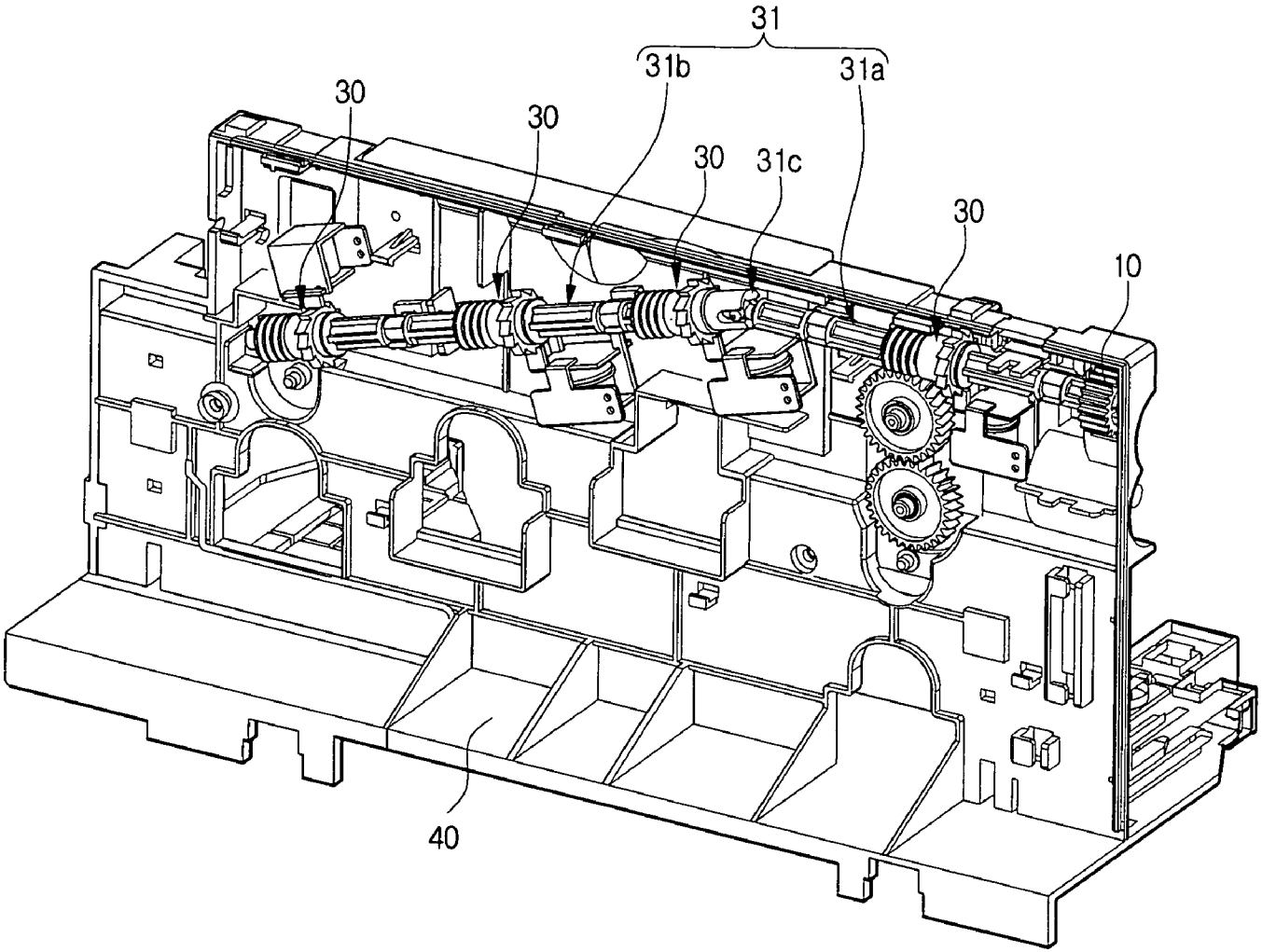
FIG. 2 is a perspective view of the toner supplying device without the toner receptacles illustrated in FIG. 1.
Figure 3:
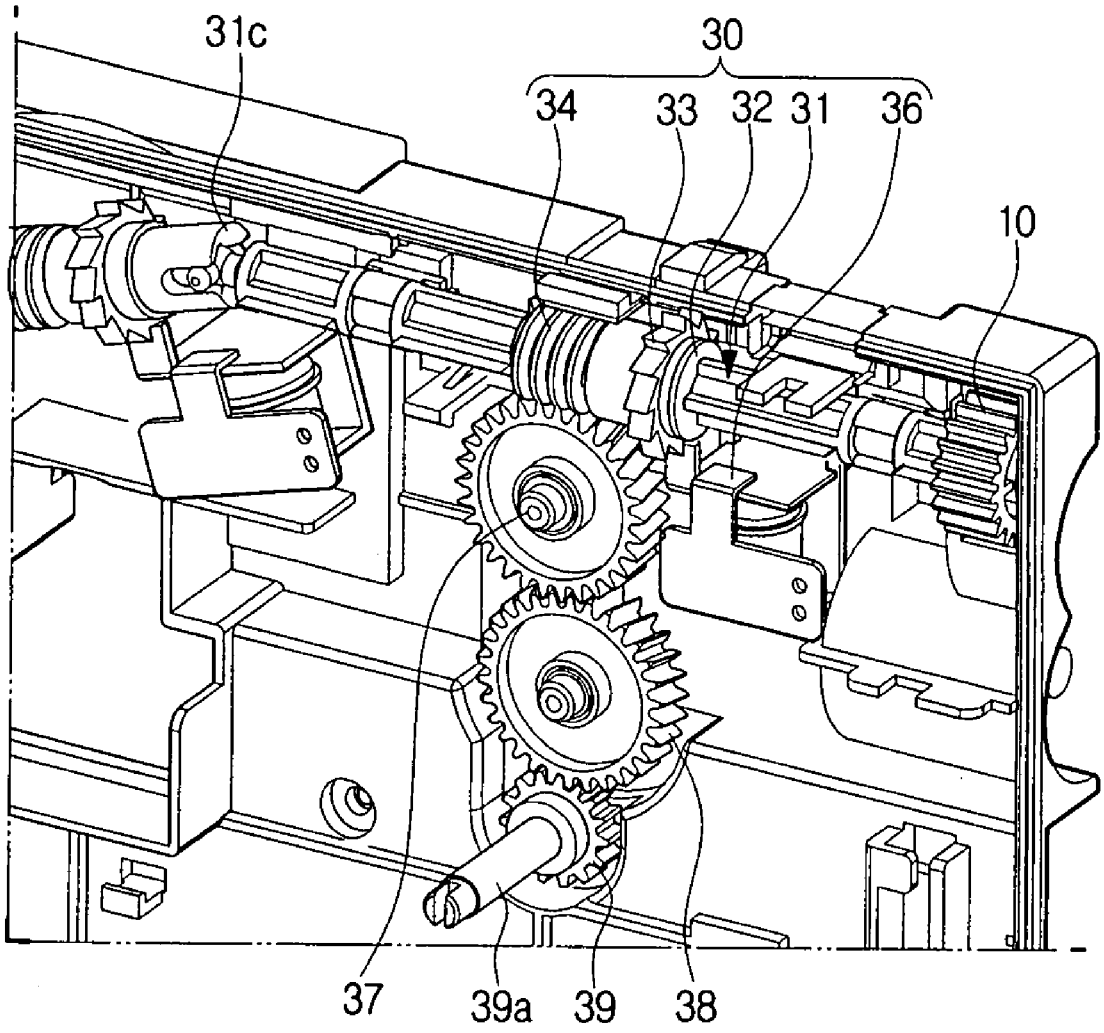
FIG. 3 is a detailed view of the main parts of the exemplary embodiments of the present general inventive concept.

FIGS. 1 to 3 are views illustrating a toner supplying device of an image forming apparatus according to an exemplary embodiment of the present general inventive concept. In FIGS. 1 to 3, reference numeral 10 represents a driving source, reference numeral 20 represents toner receptacles, reference numeral 30 represents spring clutches, and reference numeral 40 represents a developing case.

The driving source 10 may include a driving gear rotatably installed on one side of the developing case 40. In this case, power may be transmitted by connecting the driving source to other power devices through a gear train (not illustrated) or the like. Alternatively, the driving source 10 may comprise a separate motor or the like.

The four toner receptacles 20 respectively store yellow, magenta, cyan, and black color toners, and are detachably disposed on appropriate positions of the developing case 40. Specifically, each of the toner receptacles 20 includes a toner discharging member (not illustrated) such as an auger to discharge toners from inside the toner receptacles to the outside while being driven by power transmitted from the driving source 10. The toners that are discharged from the toner receptacles by driving the toner discharging member are supplied to toner containers 110 (referring to FIG. 6) containing four respective color toners in the developing case 40.

The four spring clutches 30 are provided corresponding to the respective toner receptacles 20 in order to selectively transmit power from the driving source 10 to the respective toner discharging member. The toner discharging members of the toner receptacles 20 corresponding to the respective spring clutches 30 are driven so that only toner which is required can be supplied to the corresponding toner container 110 (referring to FIG. 6) of a developing device 100 (referring to FIG. 6).

Figure 4A:
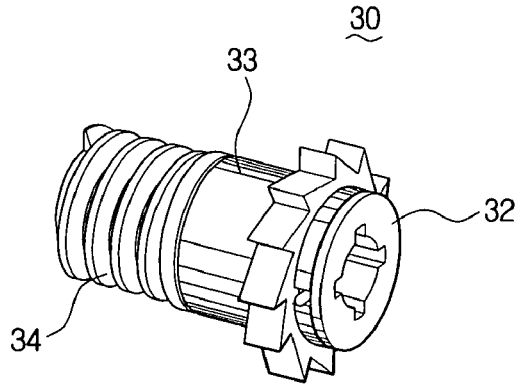
FIGS. 4A to 4B are assembled perspective views and exploded perspective views of the spring clutch which is an important part of the exemplary embodiments of the present general inventive concept.
Figure 4B:
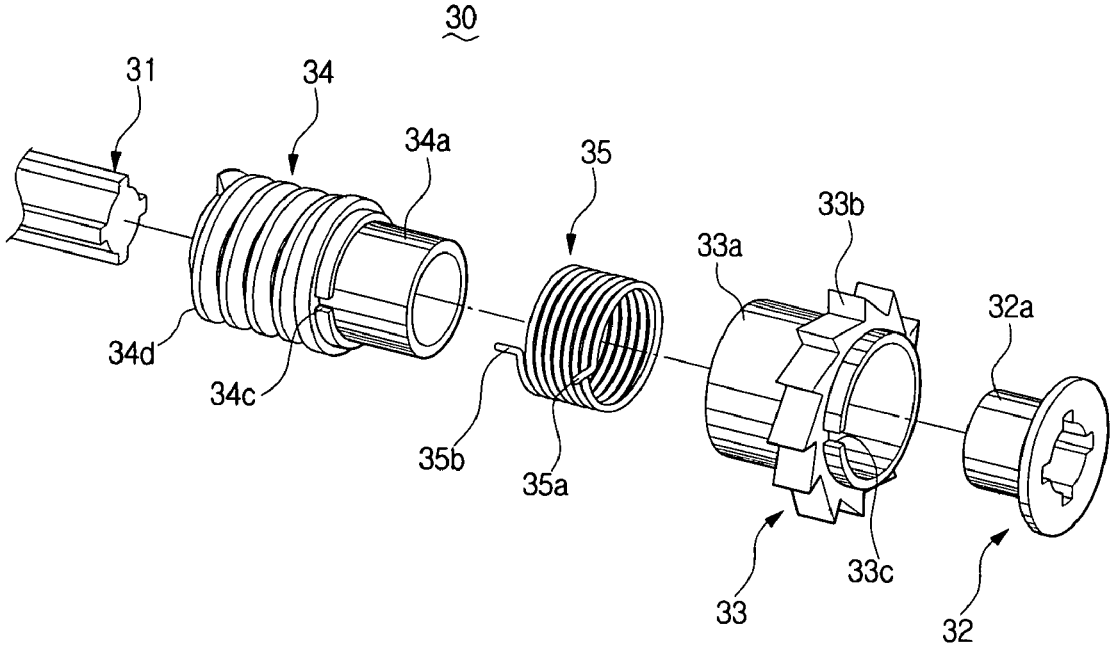

As illustrated in FIGS. 3, 4A and 4B, each of the spring clutches 30 includes a driving shaft 31 connected to the driving source 10, a clutch hub 32 connected to the driving shaft 31 so as to rotate together with the driving shaft 31, a clutch collar 33 and a first gear member 34 which are mounted on the driving shaft 31 so as to be selectively rotated, a spring 35 selectively connecting the clutch hub 32 to the first gear member 34 so that power is transmitted, and a solenoid 36 to stop the rotation of the clutch collar 33 to release the connection between the spring 35 and the clutch hub 32.

The exemplary embodiments of the present general inventive concept illustrate a structure in which a first shaft 31*a* and a second shaft 31*b* of the driving shaft 31 are connected by a universal joint 31*c* by disposing the four toner receptacles 20 on an incline, but the present general inventive concept is not limited to this structure. For example, in this structure, when one driving shaft 31 is employed and an idle gear (not illustrated) is disposed between the driving shaft 31 and toner receptacles 20, power can be transmitted. Additionally, when the four toner receptacles 20 are disposed in a straight line unlike the above structure, power can be transmitted using one driving shaft without a separate idle gear.

The clutch hub 32 and the driving shaft 31 engage with splines or serrations, and accordingly the clutch hub 32 can rotate together with the driving shaft 31 when the driving shaft 31 rotates. The clutch hub 32 includes a drum unit 32*a*.

The clutch collar 33 includes a drum unit 33*a* and a latch unit 33*b*, and is selectively rotated on the driving shaft 31. The clutch hub 32 is disposed on the interior of the clutch collar 33, and the inner circumference of the clutch collar 33 is spaced at a predetermined interval from the outer circumference of the clutch hub 32.

The first gear member 34 includes a worm 34*d* and a drum unit 34*a*. The first gear member 34 is selectively rotated on the driving shaft 31 similarly to the clutch collar 33. Additionally, a second gear member 37 (see FIG. 5) is provided to mesh with the first gear member 34 at the worm 34*d*, and includes a worm gear to engage with the worm 34*d*. Furthermore, as illustrated in FIG. 3, the second gear member 37 may mesh with the idle gear 38, and the idle gear 38 may mesh with a third gear member 39 having a connector 39*a* which connects to the toner discharging members inside the toner receptacles 20.

As illustrated in FIG. 3, since the black toner receptacle 20 (not illustrated, but connects with the connector 39*a*) is disposed far apart from the driving shaft 31, power is transmitted to the toner discharging member of the black toner receptacle 20 using the idle gear 38 and the third gear member 39. However, when the toner receptacle 20 is not disposed apart from the driving shaft 31, it is possible to form a connector of the toner discharging member in the second gear member 37 or the idle gear 38 without using the third gear member 39.

The clutch spring 35 encloses the drum unit 32*a* of the clutch hub 32 and the drum unit 34*a* of the first gear member 34. One end 35*a* of the clutch spring 35 fixes to a fixing groove 33*c* of the clutch collar 33, and the other end 35*b* thereof fixes to a fixing groove 34*c* of the first gear member 34. For example, when the clutch spring 35 is rotated in a counter-clockwise direction, the clutch spring 35 attaches to the drum unit 32*a* of the clutch hub 32 while being wound so that the rotational force of the clutch hub 32 may be transmitted to the first gear member 34. In this case, the clutch collar 33 also rotates together with the clutch spring 35. However, when stopping the rotation of the clutch collar 33, the clutch spring 35 may be unwound and released from the clutch hub 32 so that the rotational force transmitted to the first gear member 34 from the clutch hub 32 can be cut off.

Figure 5:
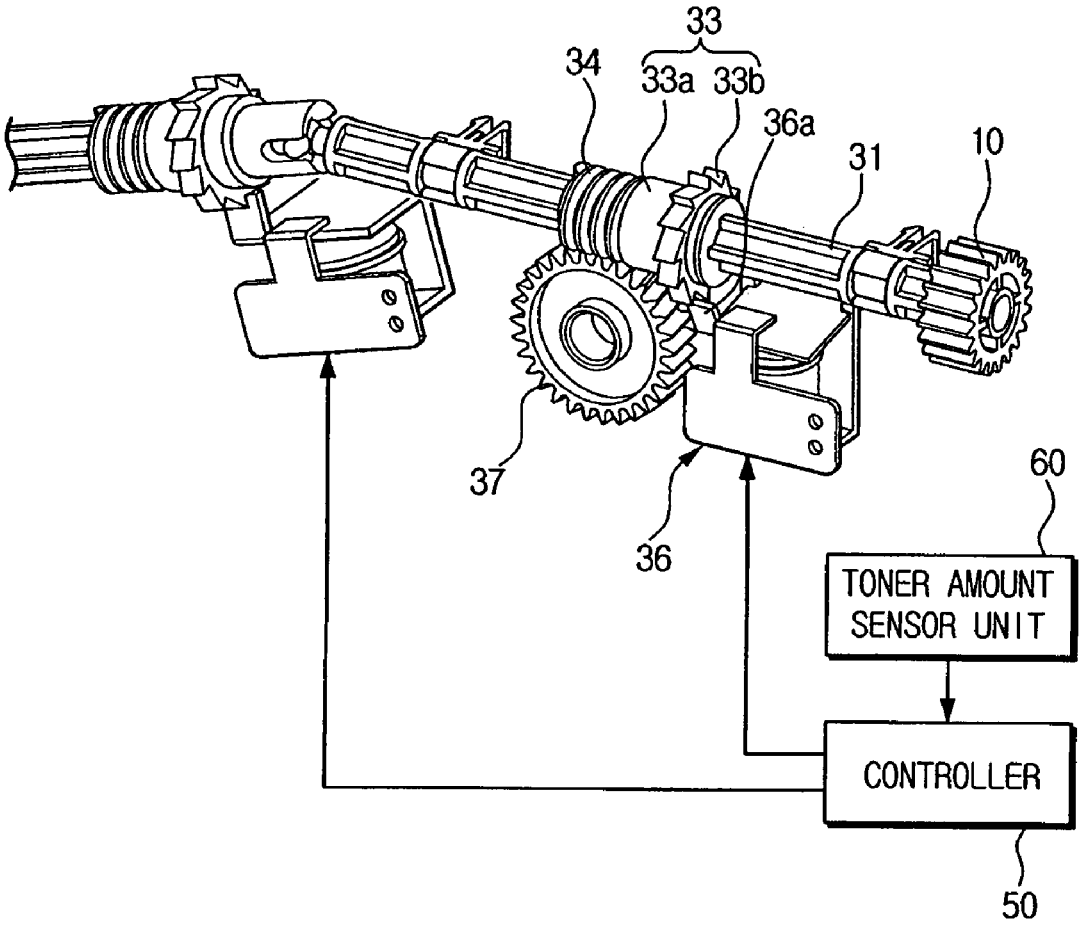
FIG. 5 is a view explaining the operation of the spring clutch which is an important part of the exemplary embodiments of the present general inventive concept.

The solenoid 36 releases the connection between the clutch spring 35 and clutch hub 32 by selectively stopping the rotation of the clutch collar 33, and includes a locking projection 36*a* (see for example FIG. 5). When the solenoid 36 is turned off, the locking projection 36*a* is lifted up and comes into contact with the latch unit 33*b* of the clutch collar 33 to stop the rotation of the clutch collar 33. Additionally, when the solenoid 36 is turned on, the locking projection 36*a* moves away from the clutch collar 33 and unlocks the clutch collar 33 to allow it to be rotated.

The solenoid 36 as described above is turned on or off by a controller 50 as illustrated in FIG. 5. The controller 50 receives information from a toner amount sensor unit 60 to drive the solenoid 36. The toner amount sensor unit 60 detects the amount of toner stored in each toner container 110 of the developing device 100 and transmits the information on the toner amount to the controller 50. The controller 50 determines which color toner currently has an insufficient amount based on the information, and as a result, the corresponding solenoid 36 is turned on, so that the toner discharging member of the corresponding toner receptacle 20 containing the required toner is driven.

Figure 6:
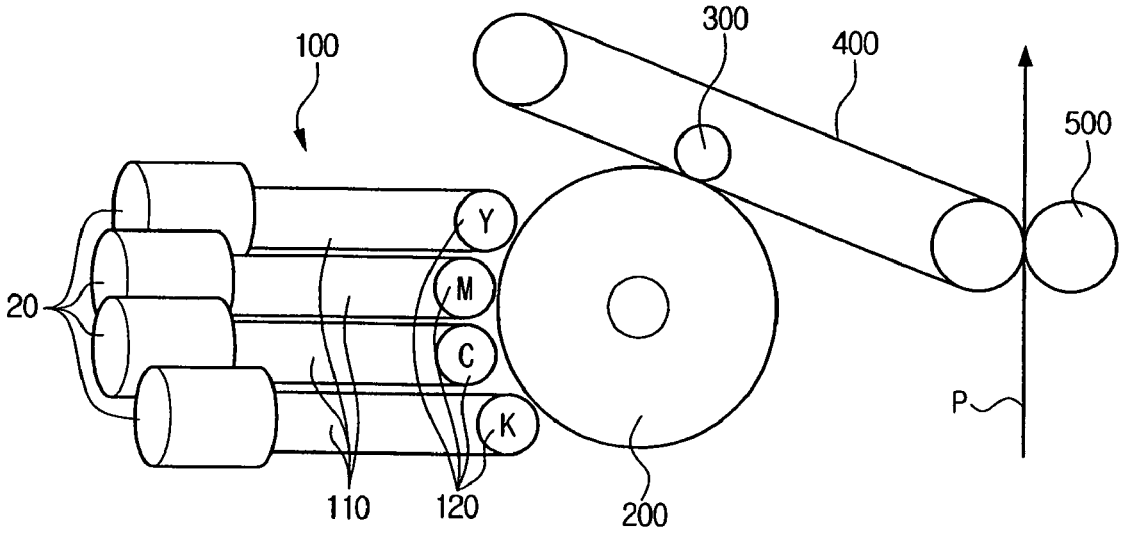
FIG. 6 is a schematic view of an image forming apparatus having a developing device that employs the toner supplying device according to an exemplary embodiment of the present general inventive concept.

FIG. 6 is a schematic view of an image forming apparatus having the developing device 100 that employs the above toner supplying device. The developing device 100 includes the developing case 40 (referring to FIGS. 1 and 2) including the four toner containers 110 storing toners of four respective colors, a developing roller 120 rotatably installed at each end of the toner containers 110, and the toner supplying device as described above.

In FIG. 6, reference numeral 200 is a photosensitive medium. On the photosensitive medium 200, a predetermined electrostatic latent image is formed by scanning a laser beam using an exposure unit (not illustrated). The developing device 100 develops the electrostatic latent image on the photosensitive medium 200 wherein a required color toner is transferred and attached.

A predetermined color toner image developed on the photosensitive medium 200 is primarily transferred by a T1 transfer roller 300 onto an intermediate transfer belt 400 sequentially. Accordingly, four color toner images overlap on the intermediate transfer belt 400 and a full color image is then transferred.

The full color image transferred on the intermediate transfer belt 400 is then transferred by a T2 transfer roller 500 onto a printing medium P. The color image transferred onto the printing medium P is completely fixed by the fixing unit (not illustrated), and the printing medium P on which the color image is fixed is discharged.

During this printing operation as described above, the toner amount sensor unit 60 (referring to FIG. 5) detects the amount of toner stored in each toner container 110 and transmits the information on the toner amount to the controller 50. The controller 50 determines which toner container 110 currently has an insufficient amount of color toner therein, based on the information from the toner amount sensor unit 60.

As the result of the determining of the amount of toner, if it is determined that black toner has an insufficient amount, as in FIG. 5, the corresponding solenoid 36 may be turned on by the spring clutch 30 for the black toner so that power can be transmitted to the respective toner discharging member of the black toner receptacle 20. In detail, if it is determined that the toners are sufficient in the toner containers 110 for all colors, all power may be cut off by the four spring clutches 30, that is, the solenoid 36 may stop the rotation of the clutch collar 33. Accordingly, the first gear member 34 is not rotated, and only the driving shaft 31 is rotated.

In this case, when the solenoid 36 of the spring clutch 30 for the black toner is turned on, the solenoid 36 unlocks the clutch collar 33, and accordingly the clutch spring 35 is wound momentarily by the elasticity of the clutch spring 35. Therefore, the clutch spring 35 comes into contact with the drum unit 32*a* of the clutch hub 32, and the clutch spring 35 and the drum unit 32*a* of the clutch hub 32 then adhere more closely to each other. Accordingly, the clutch spring 35 rotates together with the clutch hub 32. This rotational force is transmitted to the first gear member 34, and the first gear member 34 rotates accordingly.

When the first gear member 34 rotates, the second gear member 37 meshed with the first gear member 34 rotates, and the idle gear 38 and the third gear member 39 rotate. Accordingly, the toner discharging member in the toner receptacle 20 rotates to supply the toner in the toner receptacle to the toner container 110. At this time, the solenoids 36 of the spring clutches 30 for the other color toners are turned off, so that power transmission to the toner discharging members of the other toner receptacles is cut off.

When the black toner is supplied in the toner container 110 to the level required, the amount of toner is detected by the toner amount sensor unit 60, and information on the amount of toner is transmitted to the controller 50 to turn off the solenoid 36. Accordingly, the rotation of the clutch collar 33 is stopped, and the connection between the clutch spring 35 and the clutch hub 32 is released by unwinding the clutch spring 35 winding around the drum unit 32*a* of the clutch hub 32. In other words, the first gear member 34 does not rotate any more.

Using the above method, only the color toner that has an insufficient amount can be supplied to the corresponding toner container. The method of supplying only one color toner is described above, but if it is determined that two or three color toners have insufficient amounts, the solenoids of the spring clutches for the corresponding color toners are turned on so that it is possible to supply two or three color toners that have insufficient amounts to the corresponding toner containers simultaneously.

As described above, according to the exemplary embodiments of the present general inventive concept, since an inexpensive and small spring clutch is used, it is possible to achieve miniaturization of the developing device and the image forming apparatus. Additionally, manufacturing costs can be reduced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner supplying device comprising:

a driving source;

a plurality of toner receptacles in which different color toners are contained and respective toner discharging members are provided in order to discharge respective toners while being driven by a power transmitted from the driving source; and a plurality of spring clutches to selectively transmit power from the driving source to a respective one of the toner discharging members, each of the spring clutches including:

a driving shaft connected to the driving source;

a clutch collar mounted directly to the driving shaft to be selectively rotated; and a solenoid in selectable engagement with the clutch collar to selectively stop rotation of the clutch collar.

2. The toner supplying device as claimed in claim 1, wherein the spring clutches comprise:

a clutch hub connected to the driving shaft to rotate together with the driving shaft;

a first gear member mounted on the driving shaft to be selectively rotated; and a spring of which one end is fixed to the clutch collar and the other end is fixed to the first gear member to connect the clutch hub to the first gear member and that is selectively released from connection with the clutch hub in response to the solenoid engaging the clutch collar.

3. The toner supplying device as claimed in claim 2, wherein a second gear member is meshed with the first gear member, and the first and second gear members have power transmission structures of worms and worm gears.

4. The toner supplying device as claimed in claim 2, wherein the driving shaft and the clutch hub are engaged with splines or serrations.

5. The toner supplying device as claimed in claim 1, wherein four toner receptacles and four spring clutches are provided, and the spring clutches control power transmitted to the toner discharging members of each toner receptacle.

6. A developing device comprising:

a developing case comprising a plurality of toner containers to contain toners of different colors;

a developing roller mounted to each end of the toner containers of the developing case; and a toner supplying device capable of individually supplying each toner to the corresponding toner containers, wherein the toner supplying device comprises:

a driving source;

a plurality of toner receptacles in which different color toners are contained and respective toner discharging members are provided to discharge toners while being driven by a power transmitted from the driving source; and a plurality of spring clutches to selectively transmit power from the driving source to respective ones of the toner discharging members, each of the clutch springs including:

a driving shaft connected to the driving source;

a clutch collar mounted directly to the driving shaft to be selectively rotated; and a solenoid in selectable engagement with the clutch collar to selectively stop rotation of the clutch collar.

7. The developing device as claimed in claim 6, wherein the spring clutches comprise:

a clutch hub connected to the driving shaft to rotate together with the driving shaft;

a first gear member mounted on the driving shaft to be selectively rotated; and a spring having one end fixed to the clutch collar and the other end fixed to the first gear member to connect the clutch hub to the first gear member and that is selectively released from connection with the clutch hub in response to the solenoid engaging the clutch collar.

8. The developing device as claimed in claim 7, further comprising:

a second gear member meshed with the first gear member, and the first and second gear members have power transmission structures of worms and worm gears.

9. The developing device as claimed in claim 7, wherein the driving shaft and the clutch hub are engaged with splines or serrations.

10. The developing device as claimed in claim 6, wherein four toner receptacles and four spring clutches are provided, and the spring clutches control power transmitted to the toner discharging members of each toner receptacle.

11. The developing device as claimed in claim 7, comprising:

a toner amount detecting sensor unit to detect an amount of toner contained in each toner container; and a controller to receive information from the toner amount detecting sensor unit to drive the solenoid corresponding to the toner container containing toner in insufficient amounts.

12. An image forming apparatus comprises:

a photosensitive medium on which an electrostatic latent image is formed; and a developing device to develop the electrostatic latent image formed on the photosensitive medium in which toners of different colors are transferred and attached, wherein the developing device comprises:

a developing case comprising a plurality of toner containers to contain toners of different colors;

a developing roller mounted to each end of the toner containers of the developing case; and a toner supplying device capable of individually supplying each toner to the corresponding toner containers, wherein the toner supplying device comprises:

a driving source;

a plurality of toner receptacles in which different color toners are contained and respective toner discharging members are provided to discharge toners while being driven by a power transmitted from the driving source; and a plurality of spring clutches to selectively transmit power from the driving source to respective ones of the toner discharging members, each of the spring clutches including:

a driving shaft connected to the driving source;

a clutch collar mounted directly to the driving shaft to be selectively rotated; and a solenoid in selectable engagement with the clutch collar to selectively stop rotation of the clutch collar.

13. The image forming apparatus as claimed in claim 12, wherein the spring clutches comprise:

a clutch hub connected to the driving shaft to rotate together with the driving shaft;

a first gear member mounted on the driving shaft to be selectively rotated;

a spring of which one end is fixed to the clutch collar and the other end is fixed to the first gear member to connect the clutch hub to the first gear member and that is selectively released from connection with the clutch hub in response to the solenoid engaging the clutch collar.

14. The image forming apparatus as claimed in claim 13, further comprising:

a second gear member meshed with the first gear member, and the first and second gear members have power transmission structures of worms and worm gears.

15. The image forming apparatus as claimed in claim 13, wherein the driving shaft and the clutch hub are engaged with splines or serrations.

16. The image forming apparatus as claimed in claim 12, wherein four toner receptacles and four spring clutches are provided, and the spring clutches control power transmitted to the toner discharging members of each toner receptacle.

17. The image forming apparatus as claimed in claim 13, further comprising:

a toner amount detecting sensor unit to detect an amount of toner contained in each toner container; and a controller to receive information from the toner amount detecting sensor unit to drive the solenoid corresponding to the toner container containing toner in insufficient amounts.

18. A toner supplying device comprising:

a plurality of toner receptacles in which different color toners are contained and respective toner discharging members are provided in order to discharge toners from corresponding toner receptacles when driven by a driving source; and a plurality of driving shafts connected along a line by universal joints, each driving shaft corresponding to a respective one of the toner receptacles, each one of the plurality of driving shafts driven independently of the others to drive the respective discharging member.

19. The toner supplying device as claimed in claim 18, further comprising:

a plurality of spring clutches, each spring clutch connected with a respective one of the drive shafts to selectively transmit power from the driving source to a respective one of the toner discharging members via the respective connected drive shaft.

20. The toner supplying device as claimed in claim 19, wherein each spring clutch comprises:

a respective drive shaft connect to the driving source;

a clutch hub connected to the respective drive shaft to rotate together with the drive shaft;

a clutch collar and a first gear member mounted on the driving shaft to be selectively rotated;

a spring selectively connecting the clutch hub to the first gear member to transmit power; and a solenoid to stop the rotation of the clutch collar to release the connection between the spring and the clutch hub.

* * * * *